US011724866B2

(12) United States Patent
Perell

(10) Patent No.: US 11,724,866 B2
(45) Date of Patent: Aug. 15, 2023

(54) PACKAGE WITH UNIQUE OPENING DEVICE AND METHOD OF PRODUCING PACKAGES

(71) Applicant: PopPack LLC, San Francisco, CA (US)

(72) Inventor: William S. Perell, San Francisco, CA (US)

(73) Assignee: PopPack LLC, San Francisco, CA (US)

( * ) Notice: Subject to any disclaimer, the term of this patent is extended or adjusted under 35 U.S.C. 154(b) by 0 days.

(21) Appl. No.: 16/791,082

(22) Filed: Feb. 14, 2020

(65) Prior Publication Data

US 2020/0262631 A1 Aug. 20, 2020

Related U.S. Application Data

(60) Provisional application No. 62/806,223, filed on Feb. 15, 2019.

(51) Int. Cl.

| | |
|---|---|
| ***B65D 75/42*** | (2006.01) |
| ***B65D 75/52*** | (2006.01) |
| ***B65D 75/12*** | (2006.01) |

(52) U.S. Cl.

CPC ..... *B65D 75/42* (2013.01); *B65D 75/12* (2013.01); *B65D 75/527* (2013.01)

(58) Field of Classification Search

CPC ..... B65D 75/42; B65D 75/12; B65D 75/527
See application file for complete search history.

(56) References Cited

U.S. PATENT DOCUMENTS

| | | | |
|---|---|---|---|
| 2,325,921 | A | 8/1943 | Salfisberg |
| 2,333,587 | A | 11/1943 | Salfisberg |
| RE24,251 | E | 12/1956 | Kaplan et al. |
| 2,916,886 | A | 12/1959 | Robbins |
| 3,074,544 | A | 1/1963 | Bollmeier et al. |
| 3,120,336 | A | 2/1964 | Whatley, Jr. |
| 3,189,227 | A | 6/1965 | Hobbs et al. |
| 3,217,871 | A | 11/1965 | Robert |
| 3,256,981 | A | 6/1966 | Kurtz |
| 3,294,227 | A | 12/1966 | Schneider et al. |
| 3,301,390 | A | 1/1967 | Via, Jr. |

(Continued)

FOREIGN PATENT DOCUMENTS

| | | |
|---|---|---|
| DE | 20314741 | 1/2004 |
| EP | 0709302 A1 | 5/1996 |

(Continued)

*Primary Examiner* — Derek J Battisti
(74) *Attorney, Agent, or Firm* — Dority & Manning, P.A.

(57) ABSTRACT

A package and a method for producing the packages are provided. The packages may comprise an enclosure configured to receive at least one product, the enclosure being sealed from the surrounding environment by two tab areas, one tab area formed at one side of the enclosure and the other tab area formed at the opposite side of the enclosure. The two tab areas are formed by selectively sealing two opposing films, each of the two tab areas comprising at least one breachable bubble configured to be breached upon application of pressure by a user, separating a sealed portion of the two films that form the surrounding tab area, allowing access to the enclosure from either or both sides of the enclosure.

12 Claims, 6 Drawing Sheets

(56) References Cited

U.S. PATENT DOCUMENTS 3,325,575 A 6/1967 Graham
3,342,326 A 9/1967 Zackheim
3,369,656 A * 2/1968 Skinner, Jr. ..... B65D 75/42 206/205
3,419,137 A 12/1968 Walck, III
3,466,356 A 9/1969 Zavitz
3,478,871 A 11/1969 Sager
3,573,069 A 3/1971 Keller et al.
3,608,709 A 9/1971 Pike
3,608,815 A 9/1971 Bunch
3,635,376 A 1/1972 Hellstrom
3,835,995 A 9/1974 Haines
3,847,279 A 11/1974 Montgomery
3,859,859 A 1/1975 White
3,921,805 A 11/1975 Compere
3,938,659 A 2/1976 Wardwell
3,941,248 A * 3/1976 Moser ..... B65D 75/327 206/531
3,960,997 A 6/1976 Sorensen
3,964,604 A 6/1976 Prenntzell
4,069,645 A 1/1978 Vetter
4,196,809 A 4/1980 Tonrey
4,223,043 A * 9/1980 Johnson ..... A23G 9/503 426/135
4,275,840 A 6/1981 Staar
4,301,923 A 11/1981 Vuorento
4,375,383 A 3/1983 Sewell et al.
4,402,402 A 9/1983 Pike
4,442,259 A 4/1984 Isgur et al.
4,485,920 A 12/1984 Skylvik
4,488,647 A 12/1984 Davis
4,511,052 A 4/1985 Klein et al.
D279,808 S 7/1985 Pharo
4,540,089 A 9/1985 Maloney
4,597,244 A 7/1986 Pharo
4,610,684 A 9/1986 Knox et al.
4,632,244 A 12/1986 Landau
4,691,373 A 9/1987 Ausnit
4,704,314 A 11/1987 Hsu et al.
4,708,167 A 11/1987 Koyanagi
4,711,359 A 12/1987 White et al.
4,759,472 A 7/1988 Strenger
4,793,123 A 12/1988 Pharo
4,798,288 A 1/1989 Holzner
4,805,767 A 2/1989 Newman
4,859,521 A 8/1989 Pike et al.
4,872,556 A 10/1989 Farmer
4,872,558 A 10/1989 Pharo
4,874,093 A 10/1989 Pharo
4,889,884 A 12/1989 Dust et al.
4,890,744 A 1/1990 Lane, Jr. et al.
4,898,280 A 2/1990 Runge
4,902,370 A 2/1990 Dust et al.
4,904,092 A 2/1990 Campbell et al.
4,917,675 A 4/1990 Taylor et al.
4,918,904 A 4/1990 Pharo
4,949,530 A 8/1990 Pharo
4,961,495 A 10/1990 Yoshida et al.
5,050,736 A 9/1991 Griesbach
5,100,028 A 3/1992 Siefert
5,114,004 A 5/1992 Isono et al.
5,126,070 A 6/1992 Leifheit et al.
5,131,760 A 7/1992 Farmer
5,137,154 A 8/1992 Cohen
5,195,658 A 3/1993 Hoshino
5,207,320 A 5/1993 Allen
5,215,221 A 6/1993 Dirksing
5,272,856 A 12/1993 Pharo
5,325,968 A 7/1994 Sowden
5,330,269 A 7/1994 Kamada et al.
5,347,400 A 9/1994 Hunter
5,352,466 A 10/1994 Delonis
5,373,966 A 12/1994 O'Reilly et al.
5,419,638 A 5/1995 Jamison
5,427,830 A 6/1995 Pharo
5,445,274 A 8/1995 Pharo
5,447,235 A 9/1995 Pharo
5,487,470 A 1/1996 Pharo
5,492,219 A 2/1996 Stupar
5,538,345 A 7/1996 Gotoh et al.
5,564,591 A 10/1996 Christine
5,588,532 A 12/1996 Pharo
5,616,337 A 4/1997 Kasianovitz et al.
5,616,400 A 4/1997 Zhang
5,631,068 A 5/1997 Smith
D386,074 S 11/1997 Pharo
5,691,015 A 11/1997 Tsukamoto et al.
5,701,996 A 12/1997 Goto et al.
5,711,691 A 1/1998 Damask et al.
5,775,491 A 7/1998 Taniyama
5,792,213 A 8/1998 Bowen
5,814,159 A 9/1998 Paley et al.
5,824,392 A 10/1998 Gothoh
5,865,309 A 2/1999 Futagawa et al.
5,870,884 A 2/1999 Pike
5,910,138 A * 6/1999 Sperko ..... B29C 65/02 604/408
5,928,213 A 7/1999 Barney et al.
5,944,709 A 8/1999 Barney et al.
5,967,308 A 10/1999 Bowen
6,001,187 A 12/1999 Paley et al.
6,007,264 A 12/1999 Koptis
6,036,004 A 3/2000 Bowen
6,068,820 A 5/2000 De Guzman
6,073,767 A 6/2000 Cohen et al.
6,131,736 A 10/2000 Faris et al.
6,152,601 A 11/2000 Johnson
6,165,161 A 12/2000 York et al.
6,198,106 B1 3/2001 Barney et al.
6,203,535 B1 3/2001 Barney et al.
6,244,746 B1 6/2001 Tokita et al.
6,273,609 B1 8/2001 Johnson
6,280,085 B1 8/2001 Beer
6,290,801 B1 9/2001 Tonrey
6,436,500 B1 8/2002 Yingst et al.
6,468,377 B1 10/2002 Sperko et al.
6,491,159 B2 12/2002 Yukihiko
6,505,383 B2 1/2003 Machacek et al.
6,547,468 B2 4/2003 Gruenbacher et al.
6,658,400 B2 12/2003 Perell et al.
6,692,150 B2 2/2004 Hoshino
6,726,364 B2 * 4/2004 Perell ..... B65D 75/5855 383/210
6,846,305 B2 1/2005 Smith et al.
6,935,492 B1 8/2005 Loeb
6,938,394 B2 9/2005 Perell
6,968,952 B2 11/2005 Crevier et al.
6,996,951 B2 2/2006 Smith et al.
7,004,354 B2 2/2006 Harper
7,040,483 B2 5/2006 Inuzuka et al.
7,051,879 B2 5/2006 Ramet
7,055,683 B2 6/2006 Bourque et al.
7,172,220 B2 2/2007 Franko, Sr.
7,175,614 B2 2/2007 Gollier et al.
7,300,207 B2 11/2007 Linneweil
7,306,095 B1 12/2007 Bourque et al.
7,306,371 B2 12/2007 Perell
7,371,008 B2 5/2008 Bonenfant
7,597,691 B2 10/2009 Kawaguchi et al.
7,644,821 B2 1/2010 Perell
7,669,736 B2 3/2010 Harper
RE41,273 E 4/2010 Perell
7,712,962 B1 5/2010 Reuhs et al.
7,757,893 B2 7/2010 Perell
7,963,201 B2 6/2011 Willoughby et al.
8,051,983 B2 * 11/2011 Simon ..... B65D 50/06 206/532
8,191,711 B2 * 6/2012 Nivala ..... A61P 25/04 206/532
8,328,017 B2 12/2012 Perell
RE44,458 E * 8/2013 Perell ..... B65D 75/5855 383/210
8,590,282 B2 * 11/2013 Perell ..... B65B 7/162 53/492

(56) References Cited

U.S. PATENT DOCUMENTS

| | | | | |
|---|---|---|---|---|
| 8,684,601 | B2 | 4/2014 | Perell | |
| 8,784,915 | B2 | 7/2014 | Evers | |
| 9,365,339 | B2 * | 6/2016 | Perell | B29C 65/48 |
| 9,802,745 | B2 | 10/2017 | Perell | |
| 2002/0150658 | A1 | 10/2002 | Morrissette et al. | |
| 2002/0170832 | A1 | 11/2002 | Klair | |
| 2003/0019781 | A1 | 1/2003 | Kocher | |
| 2003/0102229 | A1 | 6/2003 | Inzuka et al. | |
| 2003/0113519 | A1 | 6/2003 | Wasserman et al. | |
| 2004/0057638 | A1 | 3/2004 | Perell | |
| 2004/0141664 | A1 | 7/2004 | Olsen et al. | |
| 2004/0226848 | A1 | 11/2004 | Dunn-Rankin | |
| 2004/0231292 | A1 | 11/2004 | Perell | |
| 2005/0137073 | A1 | 6/2005 | Weaver | |
| 2005/0286811 | A1 | 12/2005 | Sprague et al. | |
| 2006/0023976 | A1 | 2/2006 | Alvater et al. | |
| 2006/0126970 | A1 | 6/2006 | Perell | |
| 2006/0182370 | A1 | 8/2006 | Risgalla | |
| 2007/0140597 | A1 | 6/2007 | Ozdeger Donovan et al. | |
| 2007/0235357 | A1 | 10/2007 | Perell | |
| 2007/0235369 | A1 | 10/2007 | Perell | |
| 2007/0237431 | A1 | 10/2007 | Perell | |
| 2007/0241024 | A1 | 10/2007 | Perell | |
| 2007/0284375 | A1 | 12/2007 | Perell | |
| 2007/0286535 | A1 | 12/2007 | Perell | |
| 2007/0295766 | A1 | 12/2007 | Perell | |
| 2008/0050055 | A1 | 2/2008 | Austreng et al. | |
| 2008/0212904 | A1 | 9/2008 | Perell | |
| 2009/0196534 | A1 | 8/2009 | Song et al. | |
| 2009/0226121 | A1 | 9/2009 | Veder | |
| 2010/0008602 | A1 | 1/2010 | Risgalla | |
| 2010/0142861 | A1 * | 6/2010 | Sam | B65D 31/12 383/105 |
| 2010/0278462 | A1 | 11/2010 | Sorensen | |
| 2010/0300901 | A1 | 12/2010 | Perell | |
| 2011/0192736 | A1 | 8/2011 | Perell | |
| 2011/0200275 | A1 | 8/2011 | Perell | |
| 2013/0118134 | A1 | 5/2013 | Perell | |
| 2019/0161217 | A1 | 5/2019 | Perell | |

FOREIGN PATENT DOCUMENTS

| | | | |
|---|---|---|---|
| FR | 2345363 | A1 | 10/1977 |
| FR | 2910884 | | 1/2007 |
| JP | 04215927 | A | 8/1992 |
| JP | 7/8236 | | 7/1995 |
| JP | 11029176 | A | 2/1999 |
| JP | 11-301709 | | 11/1999 |
| JP | 2000255598 | A | 9/2000 |
| JP | 2002503187 | | 1/2002 |
| JP | 2002037327 | | 2/2002 |
| JP | 2003146364 | | 5/2003 |
| WO | WO 94/07761 | | 4/1994 |
| WO | WO2009/086344 | A1 | 7/2009 |
| WO | WO2009/086346 | A1 | 7/2009 |
| WO | WO2009/088759 | A1 | 7/2009 |

* cited by examiner

PACKAGE WITH UNIQUE OPENING DEVICE AND METHOD OF PRODUCING PACKAGES

RELATED APPLICATIONS

The present application is based on and claims priority to U.S. Provisional Patent Application Ser. No. 62/806,223, filed on Feb. 15, 2019, which is incorporated herein by reference.

BACKGROUND

Many products, especially consumer products, are packaged in flexible bags made from a plastic or polymer film. Packages made from polymer films can offer various advantages. For instance, the polymer films can be wrapped tightly around the consumer products for eliminating void space. The resulting packages are not very bulky and are easy to handle. The polymer films can also be translucent, allowing a purchaser to view the contents prior to making the purchase. In addition, the polymer films can be printed with decorative graphics to make the product more attractive.

Although packages made from polymer films can provide various advantages, opening such packages can be quite difficult. For example, the polymer films must have sufficient strength to prevent against rupture during the packaging process and during subsequent transportation. Increasing the strength of the film or the seals that surround the content of the package, however, increases the difficulty in opening the package. For example, many such packages, such as packages that contain cereals, potato chips, and the like, do not include an easy opening feature. Thus, brute force or scissors need to be used in order to open the package.

Additionally, many processes known in the art for forming packages made from polymer films are not suitable for forming packages with easy opening features. For example, many known processes, such as shrink wrap processes and form, fill and seal processes, provide tightly wrapped packages made from strong materials that are intended to eliminate void space and protect the product contained therein from outside influences such as puncturing. These packaging processes, and the resulting tightly wrapped packages, prevent consumers from easily opening the packages. Further, packages may be made with multiple compartments for holding different products in each compartment. For example, a package may hold potato chips in one compartment and peanuts in a different compartment. Opening such a package provides even more of a challenge.

In view of the above, a need currently exists for a process for forming packages with easy opening features. Further, a need currently exists for a package with an opening device that facilitates easy opening of the package from multiple locations along the periphery of the package.

SUMMARY

Aspects and advantages of the invention will be set forth in part in the following description, or may be obvious from the description, or may be learned through practice of the invention.

In one embodiment, a package is provided. The package may include an enclosure and two tab areas, one tab area formed on one side of the enclosure, and the other tab area formed at the opposite side of the enclosure. The enclosure may define an interior volume configured to receive at least one consumer product. The tab areas may be formed by selectively sealing two opposing polymer films. The seal may be formed by heating the two films and applying pressure or by using an adhesive on one or both of the films and applying pressure with or without the addition of heat. The package may further include at least one breachable bubble formed within each tab area. Sufficient fluid may be trapped within each breachable bubble such that each bubble breaches upon application of pressure by a user, separating a sealed portion of the first film from the second film. The separated films can then be gripped by a user and pulled apart to open the package. Having at least one breachable bubble on each side of the enclosure allows the package to be opened from either or both sides.

In another embodiment, a method for producing the described packages is provided. The method may include providing a polymer film formed into a tube including enough material to form multiple packages. The tubular polymeric film is then sealed at intervals so as to leave a series of enclosures separated by seals that form the two tab areas of each package. The sealed areas may be perforated along a centerline of each seal so that the packages can be easily separated from each other and so that each seal forms the top tab of one package and the bottom tab of an adjacent package. The seals may also each include at least one breachable bubble on each side of every perforated line. Each enclosure may define an interior volume configured to receive at least one consumer product. Fluid trapped within each sealed area to form at least one breachable bubble on each side of the perforated centerline may be sufficient to cause each bubble to breach upon application of pressure by a user, separating a sealed portion of the first film from the second film, allowing the user to open the package.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
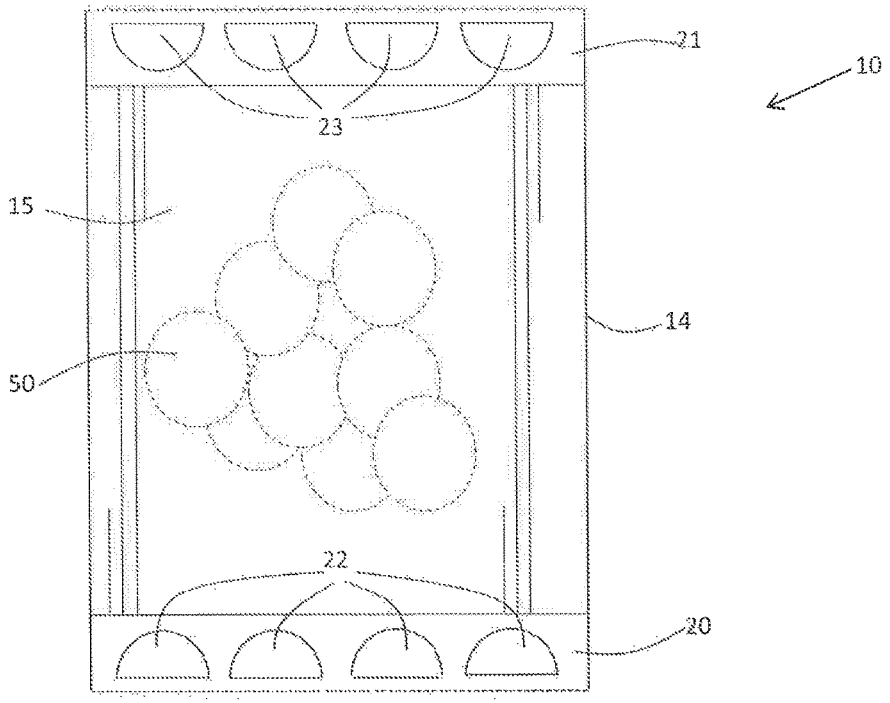
FIG. 1 provides a top view of one embodiment of a package made in accordance with the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

In general, the present invention is directed to a package that includes a unique opening device for opening the package, and to a method for producing the packages. The package, in one embodiment, can be made from one or more layers of a polymer film. The walls of the package, for example, can be flexible. In the past, such packages have been relatively difficult to open. In accordance with the present disclosure, however, the package includes at least one breachable bubble formed within each of two tab areas formed within the package. Sufficient fluid may be trapped within each breachable bubble such that the bubble may breach upon application of pressure by a user. Breaching of each bubble can cause a sealed portion of the polymeric layers comprising the tabs to separate. The layers of polymer film can then be peeled away from each other until the package is opened and its contents are accessible.

In some embodiments of the present invention, the package may include multiple compartments configured for receiving products. The different compartments within a package may be configured to hold different products in each compartment, such as potato chips in one compartment and peanuts in another. In some embodiments the package may include two, three, or four separate compartments. In the past, it would be especially difficult to open a package so as to only access a certain compartment of the package. In accordance with the present disclosure, however, the package may include at least one breachable bubble configured for opening each compartment. For example, the portion of the tab directly sealing a certain compartment may include at least one breachable bubble capable of separating only the portion of the tab necessary to access the certain compartment upon pressure applied by a user.

Referring to FIG. 1, reference numeral 10 generally indicates a package in accordance with one embodiment of the present invention. The package 10 may include a first flexible polymer film 11 and a second flexible polymer film 12 (see FIG. 4). In one embodiment of the present invention, the first film 11 and the second film 12 are portions of a singular sheet of flexible polymer film. In another embodiment, the first film 11 and the second film 12 are separate sheets of flexible polymer film. It should be understood that the package 10 can have any suitable shape depending upon various factors including the type of product contained in or to be received in the package.

The first flexible polymer film 11 and the second flexible polymer film 12 can be made from any suitable polymer. Polymers that may be used to form the package include, for instance, polyolefins such as polyethylene and polypropylene, polyesters, polyamides, polyvinyl chloride, mixtures thereof, copolymers thereof, terpolymers thereof, and the like. In addition, the package can also be made from any suitable elastomeric polymer.

The first flexible polymer film 11 and the second flexible polymer film 12 can each comprise a single layer of material or can comprise multiple layers. For instance, the first film 11 and the second film 12 can each include a core layer of polymeric material coated on one or both sides with other functional polymeric layers. The other functional polymeric layers may include, for instance, an oxygen barrier layer, an ultraviolet filter layer, an anti-slip layer, a printed layer, and the like. It should also be understood that the first flexible polymer film 11 can comprise different material than the second flexible polymer film 12 and vice versa. For instance, the first flexible polymer film 11 can comprise a printed layer and an anti-slip layer, while the second flexible polymer film 12 can comprise only a printed layer.

The first flexible polymer film 11 and the second flexible polymer film 12 can each be translucent or transparent. If translucent or transparent, for instance, the contents of the package 10 can be viewed from the outside. In another embodiment, however, the first flexible polymer film 11 and the second flexible polymer film 12 can each be opaque. For instance, in one embodiment, the package 10 can display various graphics that identify, for instance, the brand and the description of the product inside. In other embodiments, the first flexible polymer film 11 can be translucent or transparent while the second flexible polymer film 12 is opaque, and the first flexible polymer film 11 can be opaque while the second flexible polymer film 12 is translucent or transparent.

In accordance with the present disclosure, the first flexible polymer film 11 and the second flexible polymer film 12 may be sealed together to form an enclosure 14 and two tab areas 20 and 21. The enclosure 14 may define an interior volume 15 configured to receive at least one consumer product 50. In one embodiment, a consumer product 50 may be situated in the interior volume 15. The consumer product 50 may be, for example, a food product. In one embodiment, the consumer product 50 may be a cold food product. For example, in one embodiment, the consumer product 50 may be a snack food, such as potato chips which is usually maintained at room temperature.

In some embodiments, the enclosure 14 may include more than one compartment. In a preferred embodiment, represented by FIG. 2, the enclosure 14 includes a second compartment 16. In another preferred embodiment, represented by FIG. 3, the enclosure 14 further includes a third compartment 17 and a fourth compartment 18. The compartments may be sealed from each other by at least one hard seal 19. The compartments may take any shape such that each compartment is directly sealed by a portion of at least one tab area. In a preferred embodiment, represented by FIG. 2, each compartment comprises half of the enclosure 14. In another preferred embodiment, represented by FIG. 3, each compartment comprises a quarter of the enclosure 14. In another preferred embodiment, not shown in the figures, the enclosure may be split into three compartments such that two of the compartments are sealed by one tab and the third compartment is sealed by the other tab.

In embodiments including packages with more than one compartment, each compartment may contain the same product as any of the other compartments or a different product from any of the other compartments. For example, in the embodiment shown in FIG. 2, a product 50 may be stored in one compartment 15 while a different product 51 may be stored in the other compartment 16. In the embodiment shown in FIG. 3, a further third product 52 may be stored in the third compartment 17, and a fourth product 53 may be stored in the fourth compartment 18.

Figure 6:
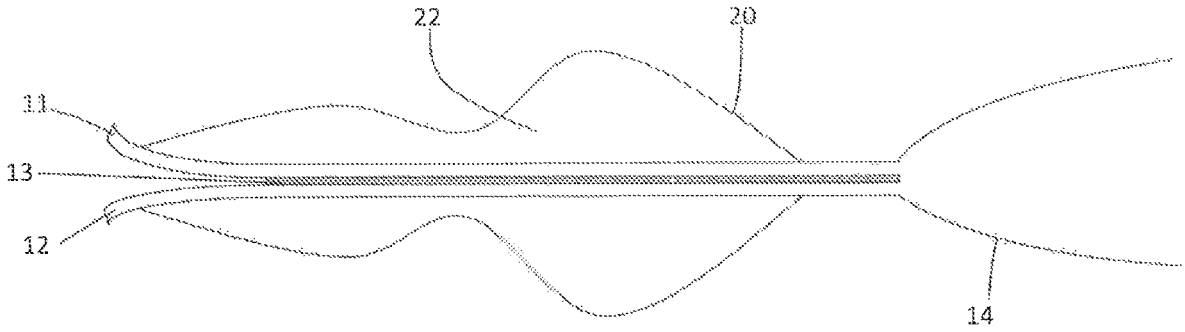
FIG. 6 provides a zoomed in side view of the tab area of one embodiment of a package made in accordance with the present disclosure, wherein the breachable bubble has been breached.
Figure 7:
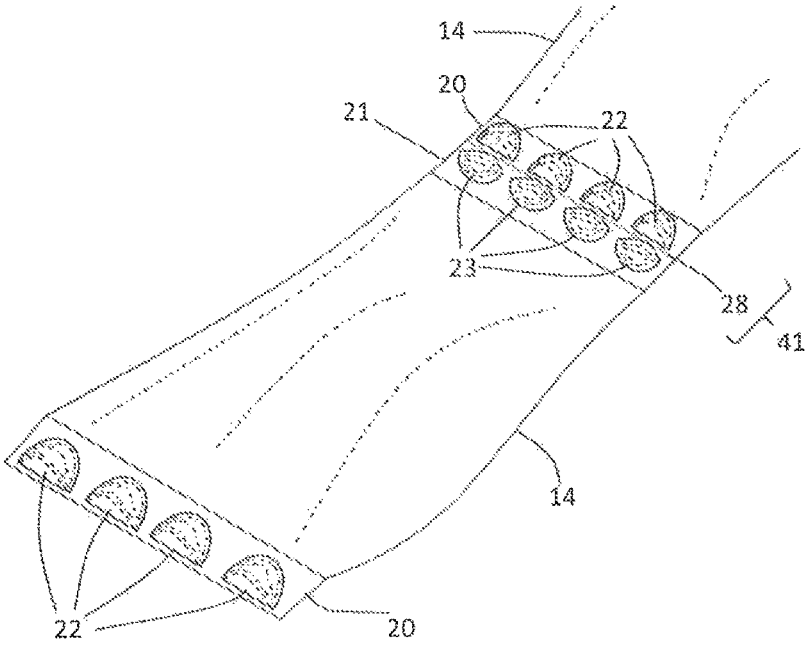
FIG. 7 provides a perspective view of one embodiment of packages made in accordance with the present disclosure.
Figure 8:
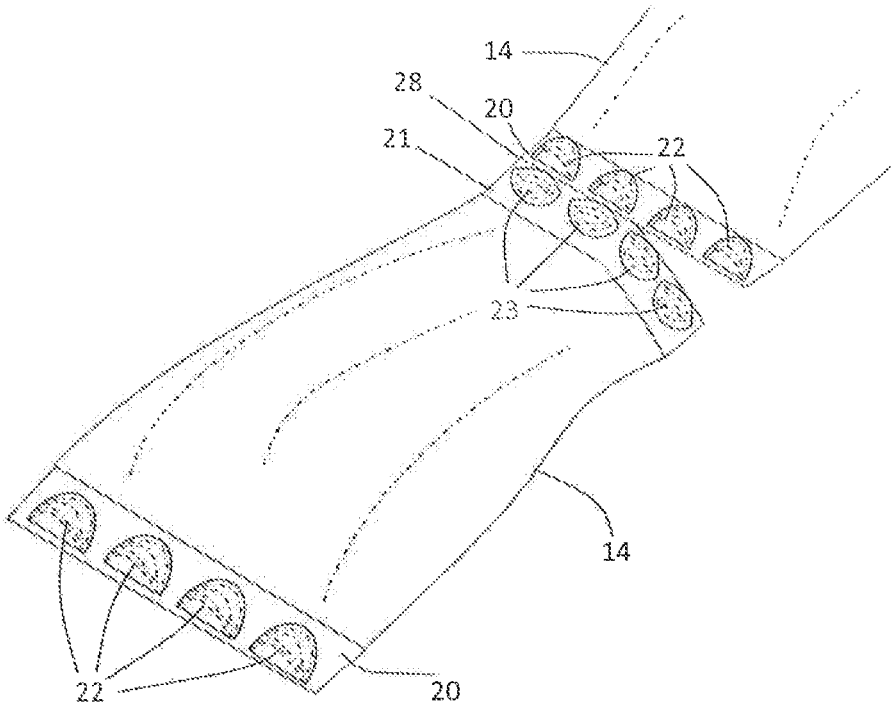
FIG. 8 provides a perspective view of one embodiment of packages made in accordance with the present disclosure, wherein the packages are partially separated.
Figure 9:
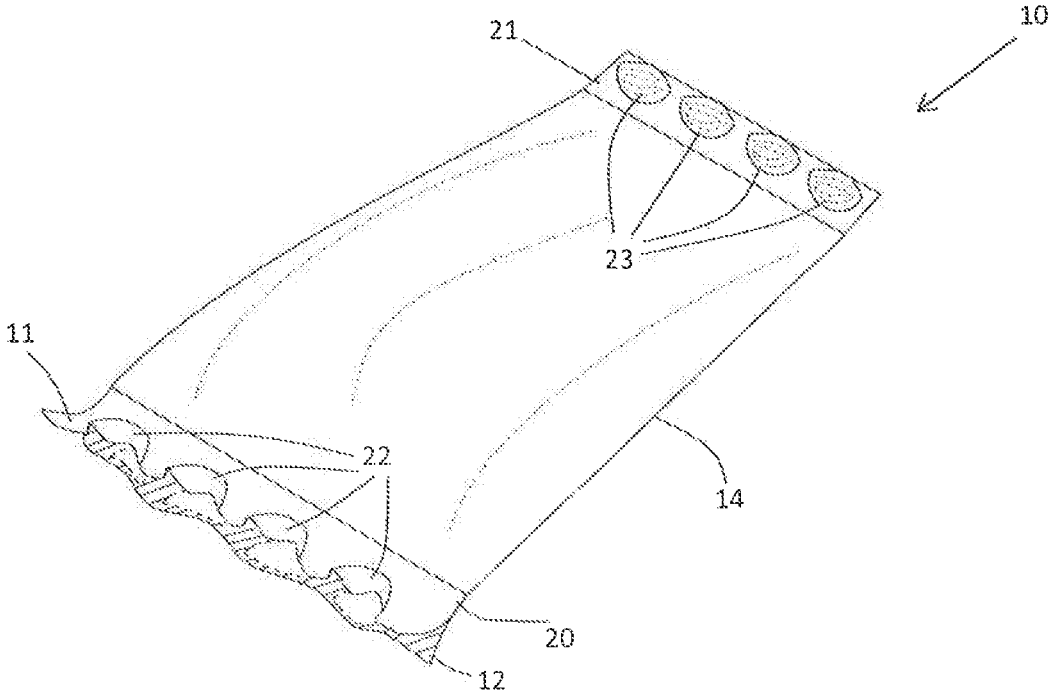
FIG. 9 provides a perspective view of one embodiment of a package made in accordance with the present disclosure, wherein the breachable bubbles have been breached and the films are partially peeled apart.

Two tabs 20 and 21 seal the enclosure 14 from the surrounding environment. One of the tabs seals one side of the enclosure and the other tab seals the opposite side of the enclosure. Referring to FIG. 1, the set of breachable bubbles 22 and the set of breachable bubbles 23 are formed within respective tab areas 20 and 21. Sufficient fluid may be trapped within each breachable bubble of the sets of breachable bubbles 22 and 23 such that upon pressure applied by a user to any bubble, the bubble breaches, separating a sealed portion of the first flexible polymer film 11 from the second flexible polymer film 12. The fluid may be, for example, a liquid or a gas. In one embodiment, the fluid may be air. Having a set of breachable bubbles on each side of the enclosure 14 allows the enclosure 14 to be easily opened from either tab 20 or tab 21 or from both tabs 20 and 21. FIG. 9 shows a package according to one embodiment being opened in the described manner; the set of breachable bubbles 22 have been breached and the two opposing films 11 and 12 have been partially peeled apart, nearly opening the package 10 from tab 20. A close up view of the partial peeling can be seen in FIG. 6, where the at least one bubble 22 has been breached, separating a portion of tab 20 which was previously sealed by adhesive 13.

Each set of breachable bubbles 22 and 23 may comprise at least one breachable bubble. In some embodiments, each set of breachable bubbles 22 and 23 may comprise a plurality of breachable bubbles, such as two, three, or four breachable bubbles. In embodiments with multiple compartments, having breachable bubbles on both sides of the enclosure 14 and having at least one bubble configured to open each compartment allows all compartments to be easily opened and allows them to be opened separately without opening any other compartments if desired. For example, referring to FIG. 4, one embodiment of packages is shown wherein each of the two packages has four internal compartments. Compartment 15 may be exclusively accessed by breaching either or both of the two bubbles within set 23 adjacent to compartment 15 and compartment 18 may be exclusively accessed by breaching either or both of the other two bubbles within set 23. At the other side, compartment 16 may be exclusively accessed by breaching either or both of the two bubbles within set 22 adjacent to compartment 16 and compartment 17 may be exclusively accessed by breaching either or both of the other two bubbles within set 22.

In one embodiment, the tab areas may have a perforated edge 28. In a preferred embodiment, the breachable bubbles are shaped like half circles. Further, the flat section of each half circular bubble is adjacent to and runs parallel to the perforated edge 28 of the tab area which encompasses it. It should be understood that the breachable bubbles can be any other shape as well. The bubbles may be formed so that the bubble only protrudes from one side of the tab such that one of the tab portions of either flexible polymer film 11 or flexible polymer film 12 remains flat. The bubbles may also be formed so that the bubbles protrude from both sides of the tab such that neither of the tab portions of film 11 or film 12 remains flat.

Figure 2:
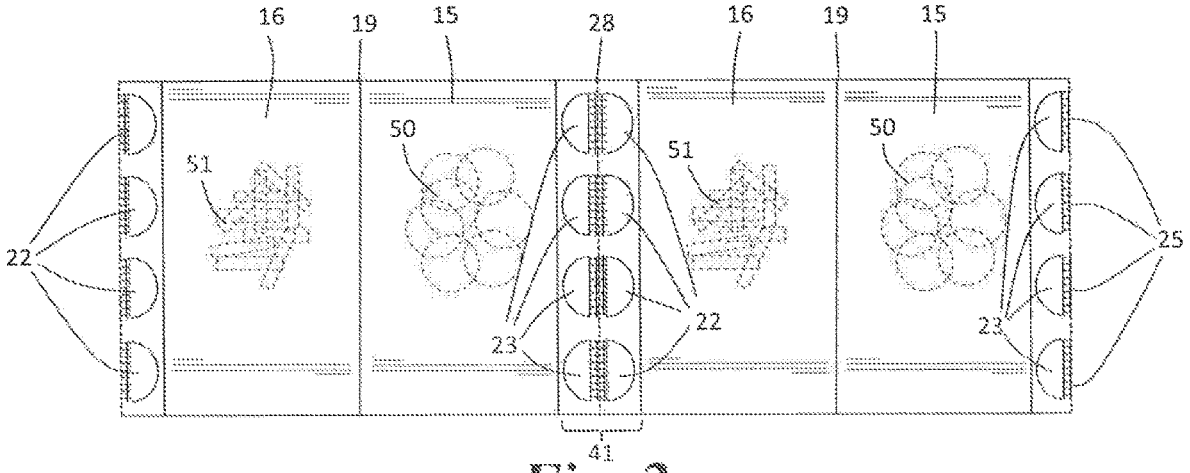
FIG. 2 provides a top view of another embodiment of packages made in accordance with the present disclosure.
Figure 3:
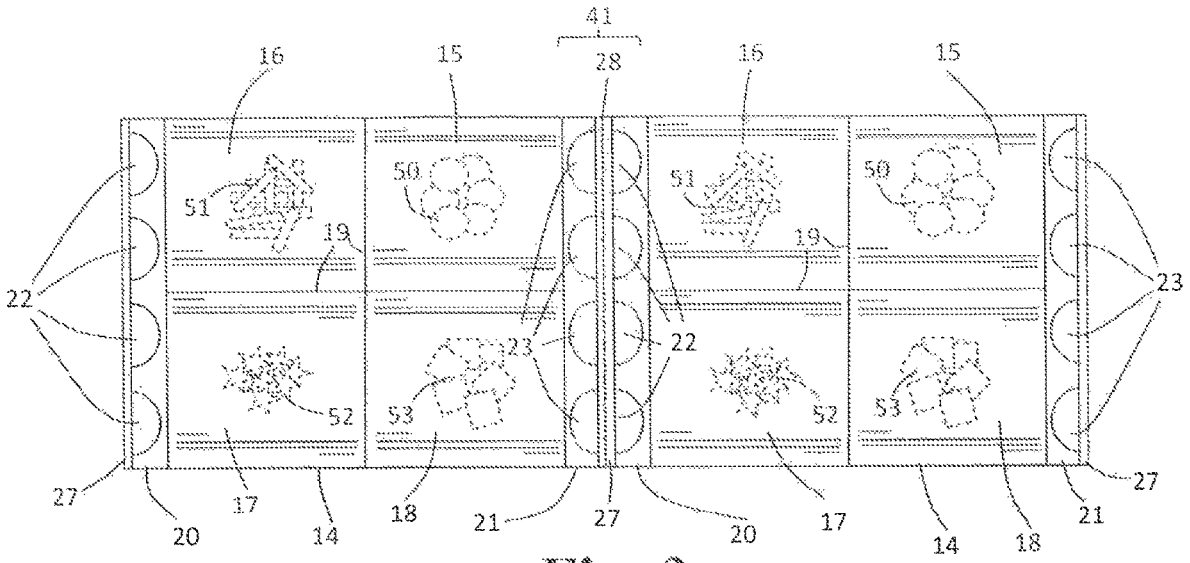
FIG. 3 provides a top view of another embodiment of packages made in accordance with the present disclosure.

In one embodiment, the tab areas 20 and 21 may each include breach points corresponding to each breachable bubble that are generally oriented towards the periphery of the package. The sets of breach points identified by numeral 25 in FIG. 2 represent sealed portions of the first flexible polymer film 11 and the second flexible polymer film 12 which more easily separate than the remainder of the sealed first film 11 and second film 12 when a corresponding breachable bubble of the set of breachable bubbles 22 or the set of breachable bubbles 23 is breached.

Each breachable bubble may provide a distinct breaching sound when the bubble is breached. The breaching sound may be caused by the trapped fluid escaping from the discrete portion of the tab area containing the bubble when the bubble is breached. For example, in one embodiment, a breachable bubble may provide a popping sound, similar to a small balloon popping, when the bubble is breached. In other embodiments, a breachable bubble may provide, for example, a peeping sound, a snapping sound, or a whistling sound.

The breachable bubbles of the sets of breachable bubbles 22 and 23 may be filled with a gas, such as air. The breachable bubbles are expandable to open the package 10 by external pressure applied by a consumer. For small bubbles, the consumer can simply pinch a bubble or bubbles between his thumb and forefinger. Slightly larger bubbles may require thumb-to-thumb pressure. Pressure can also be applied to a bubble by placing the bubble against a flat surface and applying pressure with one's fingers, palm, elbow, or other solid item such as a salt or pepper shaker.

Figure 4:
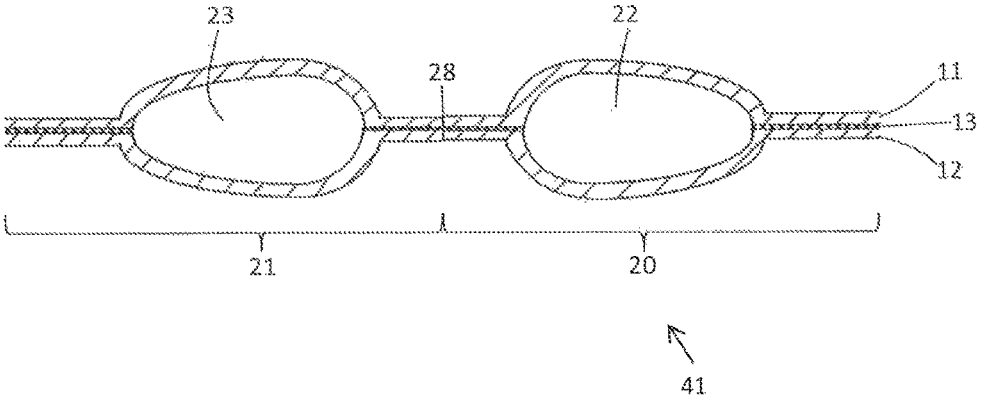
FIG. 4 provides a cross-sectional view of the sealed area between two enclosures of packages of one embodiment made in accordance with the present disclosure.
Figure 5:
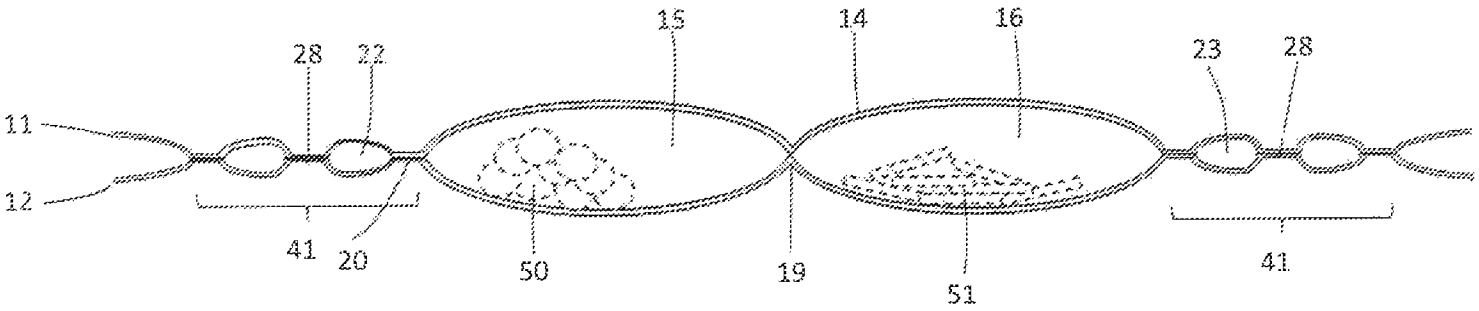
FIG. 5 provides a cross-sectional view of a package between two other packages of one embodiment made in accordance with the present disclosure.

As shown in FIG. 4, an adhesive layer 13 may provide a seal between the first flexible polymer film 11 and the second flexible polymer film 12. In one embodiment of the present invention, the adhesive layer 13 may have a chemical composition such that the adhesive layer 13 possesses the capability to form a strong bond with itself under the application of pressure. Further, the adhesive layer 13 may have the capability to form a strong bond without the need for the application of elevated temperatures. It should be understood that the adhesive layer 13 may require heat to form the seal between the two films 11 and 12.

In one embodiment, the adhesive layer 13 may comprise a cold seal adhesive (also known as a cohesive, contact adhesive, or self-seal adhesive). For example, the adhesive layer 13 may be a natural rubber-based cold seal adhesive, a synthetic polymer-based cold seal adhesive, or a natural rubber- and synthetic polymer-based cold seal adhesive. Natural rubber-based cold seal adhesives generally contain a natural rubber elastomer, such as a latex, as the predominant ingredient. Other ingredients such as tackifying resins, plasticizers, extenders, stabilizers, antioxidants, or other ingredients may be added to the natural rubber elastomer to modify the adhesive characteristics of the adhesive. Synthetic polymer-based cold seal adhesives generally contain both cohesive components, such as synthetic elastomers, and adhesive components. For instance, a wide variety of synthetic polymers, copolymers, and polymer mixtures may be included in the synthetic polymer-based cold seal adhesive composition, such as acrylic copolymers and styrene butadiene rubbers as base polymers and styrene-acrylic copolymers as secondary polymers, aqueous based polyurethanes and polyurethane isomers, and copolymers of vinyl acetate and ethylene.

Natural rubber-based and synthetic polymer-based cold seal adhesive generally include a combination of natural rubber elastomers and synthetic polymers as the predominant ingredient. For instance, copolymers of vinyl acetate and ethylene may be combined with natural rubbers to formulate cold seal adhesives.

It should be understood that the adhesive layer 13 is not limited to natural rubber-based cold seal adhesives, synthetic polymer-based cold seal adhesives, or natural rubber-based and synthetic polymer-based cold seal adhesives, but may comprise any cold seal adhesive or any adhesive that possesses the capability to form a strong bond with itself under the application of pressure and without the need for the application of elevated temperatures. Further, it should be understood that adhesive layer 13 is not limited to cold seal adhesives. For example, the adhesive layer 13 may comprise a heat seal adhesive, a drying adhesive, an emulsion adhesive, a light curing adhesive, or any other adhesive configured to seal a first flexible polymer film 11 and a second flexible polymer film 12 together.

The present invention is further directed to a method of producing packages with unique opening devices for opening the packages. In one embodiment, a plurality of packages is formed from a continuous piece of material. The material is selectively sealed at intervals, forming a series of tab areas between enclosures. Further, the sealed areas are perforated along the middle of each seal, allowing the continuous material to be separated into individual packages in a later step. Additionally, the seals each contain two sets of breachable bubbles, one set on each side of the perforations, configured to be breached upon pressure applied by a user, separating the seal, and allowing an encompassing package to be opened.

Figure 10:
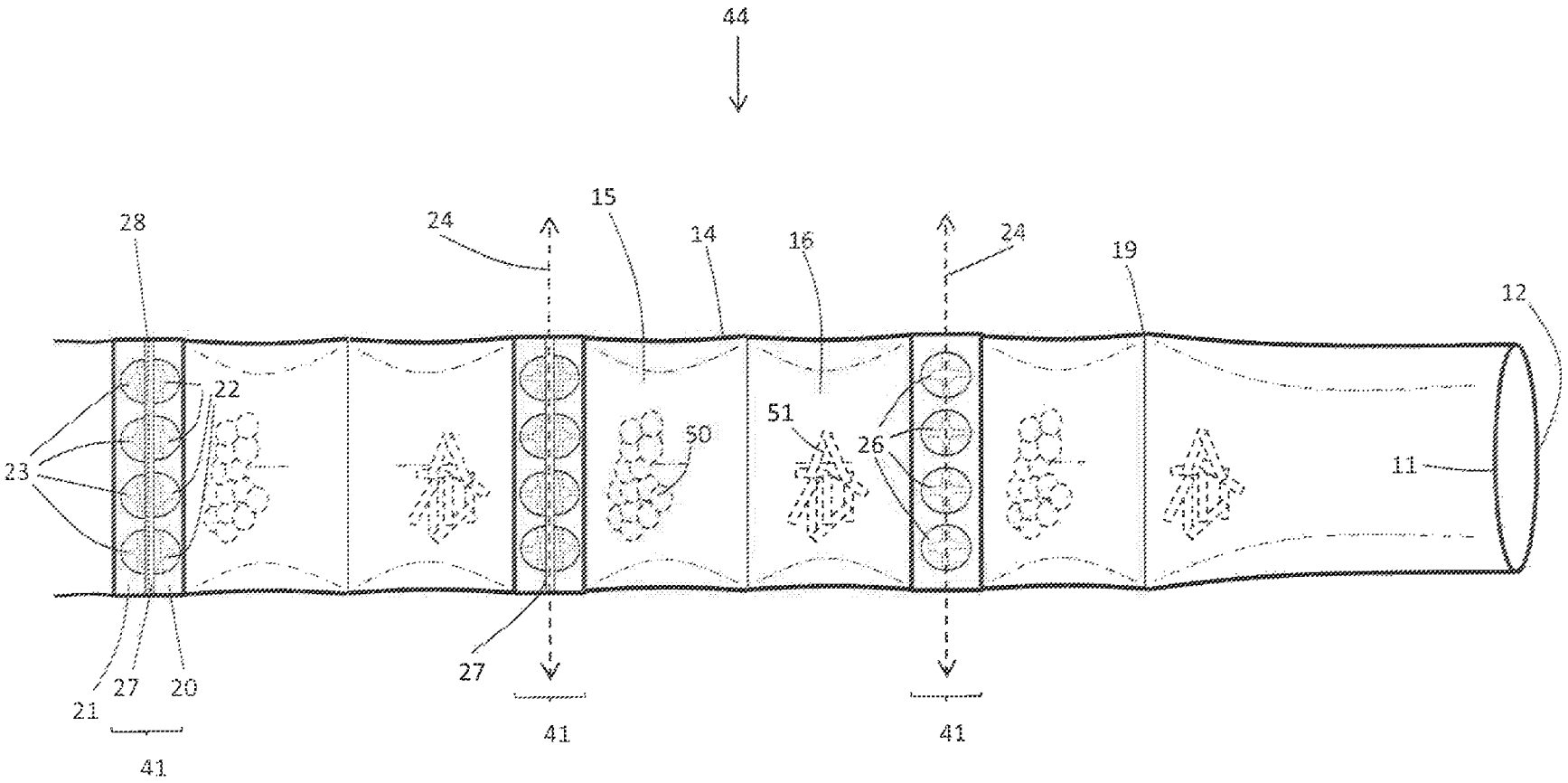
FIG. 10 provides a top view of one embodiment of the production of packages in accordance with the present disclosure.

In one embodiment of the invention, a continuous piece of material 40 comprising a single polymeric film is provided. The single polymeric film 40 may be shaped into a tube. The tube may or may not comprise a sealed seam running lengthwise along the tube. If a lengthwise seam is present, it may be a fin seal. The tube may comprise enough material to be formed into a plurality of packages. During processing of the packages, the tube of continuous polymeric material 40 may be selectively sealed, pressing the top of the tube with the bottom of the tube at intervals to form a series of sealed areas 41. In accordance with the present disclosure, the film comprising the top of the tube is the first flexible polymer film 11 and the film comprising the bottom of the tube is the second flexible polymer film 12, as shown in FIG. 10. The first flexible polymer film 11 and the second flexible polymer film 12 can be made from any suitable polymer.

In accordance with the present disclosure, the first film 11 and the second film 12 may be selectively sealed together at intervals to from a series of enclosures 14 and sealed areas 41. As discussed above, the enclosure 14 may define an interior volume 15 configured to receive at least one consumer product. In one embodiment, a consumer product 50 may be situated in the interior volume 15. The seals may be formed in sequence so that the bottom seal of each package is sealed first, forming a first sealed area that makes up the bottom tab area 20 of each package, then the at least one product may be inserted into the tube where the enclosure 14 will be formed, then another seal is formed that makes up the top tab area 21 of the package so as to form an enclosure 14 between the first seal making up the bottom tab 20 and the second seal making up the top tab 21, sealing the at least one product within the enclosure 14. The tube 41 may be sealed by applying pressure to the area to be sealed after it has been coated with an adhesive layer 13 as described above. The method for sealing may include applying heat and pressure to the area to be sealed.

The first sealed area comprises the bottom tab area 20 for a package. The second sealed area comprises the upper tab area 21 for said package and also the bottom tab area 20 for the subsequent package. The process then repeats itself continuing to form subsequent packages from the continuous film 40. The method further includes making perforations 28 across each sealed area 41 down a centerline 42 halfway between two adjacent enclosures. Centerline 42 is used for descriptive purposes only and has no physical presence. Perforations 28 may be made during the formation of each seal 41. The perforations 28 for any seal 41 may also be made after said seal is formed.

In one embodiment of the present invention, each enclosure 14 may comprise multiple internal compartments. To form packages with multiple compartments, the method for producing the packages further comprises a step of creating at least one hard seal 19 within each enclosure 14. The at least one hard seal 19 can be formed using any method known in the art. In one embodiment, a hard seal 19 runs vertically along the packages from tab area 20 to tab area 21. In this case, the hard seal 19 may be formed in the continuous tube prior to any sealed area 41 being formed. The vertical hard seal 19 may also be formed in each enclosure 14 after the bottom tab 20 is formed and before the top tab 21 is formed.

In another embodiment, a hard seal 19 runs horizontally across each enclosure 14, parallel to centerline 42. Each hard seal may be formed after the bottom tab 20 is formed and after at least one product is inserted into any internal compartments between the bottom tab 20 and the hard seal 19. Then at least one product may be inserted into any internal compartment between hard seal 19 and top tab 21. Then the top seal may be formed, creating tab 21. This process is illustrated by FIG. 10, wherein a compartment 15 exists between a hard seal 19 and a bottom tab 20 containing product 50. Product 51 is shown in the unsealed section of the tube that can afterwards be sealed to form the second compartment.

Additionally, the method for producing the packages may include trapping a fluid within discrete portions of each sealed area 41 to form one set of breachable bubbles 22 on one side of each perforated centerline 42 and another set of breachable bubbles 23 on the other side of each perforated centerline 42. As discussed above, sufficient fluid may be trapped within each breachable bubble of the sets of breachable bubbles 22 and 23 such that any bubble breaches upon application of pressure to the bubble by a user, separating a sealed portion of the first flexible polymer film 11 from the second flexible polymer film 12. Each set of breachable bubbles 22 and 23 may comprise at least one breachable bubble. In some embodiments, each set of breachable bubbles 22 and 23 may comprise a plurality of breachable bubbles, such as two, three, or four breachable bubbles.

In one embodiment, the method comprises forming at least one breachable bubble on each side of every centerline 42 within every sealed area 41 on the portion of the sealed area that directly seals each internal compartment within each enclosure 14. For example, if each enclosure 14 contains four internal compartments, two sealed by tab 20 and two sealed by tab 21, then each sealed area 41 includes at least two breachable bubbles on each side of every centerline 42.

In one embodiment, the at least one breachable bubble in the set of breachable bubbles 22 on one side of each centerline 42 may be formed separately from the corresponding at least one breachable bubble of the set of breachable bubbles 23 on the opposite side of each centerline 42. Each set of breachable bubbles may be formed during the sealing process using a similar sealing procedure to the one described in US 2011/0192736 to Perell. Each breachable bubble within a set of breachable bubbles 22 or 23 may be formed individually or concurrently with the other breachable bubbles within the set.

In another embodiment, the two sets of breachable bubbles 22 and 23 within each sealed area 41 may be formed together. One set of relatively large circular bubbles 26 may be formed across the centerline 42 of each seal 41 before any perforations 28 are made. The set of relatively large circular bubbles is then sealed down the centerline 42 of each seal 41 so that the set of circular bubbles 26 is split into two sets of breachable bubbles 22 and 23 by a seal 27, each in the shape of half circles, on opposite sides of the centerline 42, as shown in FIG. 10. The perforations 28 can be made along the centerline 42 simultaneously with the formation of the seal 27. The perforations may also be made after the formation of the seal 27 through the center of said seal 27 along the centerline 42 in a separate step. It should also be understood that the shape of the breachable bubbles is not limited to a half circle and that they can be formed in any shape. Further, the shape of the bubbles of the set of larger bubbles 26 to be split into the two sets of breachable bubbles 22 and 23 is not limited to a circle, and that they can be in any shape, such as any regular polygon.

It should be understood that the sets of breachable bubbles 22 and 23 can be formed so as to project only upwards from each sealed area 41, only downwards from each sealed area 41, or both upwards and downwards from each sealed area 41.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A series of packages formed from a continuous strip of overlapping flexible films, wherein each package comprises:

an enclosure configured to receive at least one product, the enclosure being sealed from the surrounding environment, the package including two tab areas, one tab area formed at a first side of the enclosure and the other tab area formed at an opposite second side of the enclosure;

the two tab areas being formed by selectively sealing two opposing flexible films, each of the two tab areas comprising at least one breachable bubble configured to be breached upon application of pressure by a user, separating a sealed portion of the two films that form the surrounding tab area, allowing access to the enclosure;

the enclosure configured to be accessible from either of or both of the two tab areas upon breaching of at least one of said breachable bubbles, the enclosure separating the two tab areas;

and wherein the first side of one package is positioned adjacent to a second side of an adjacent package, the breachable bubble located along the first side of one package being positioned complementary to the breachable bubble located on the second side of the adjacent package and being separated by a seal line.

2. A series of packages as defined in claim 1, wherein each of the two tab areas on each package contains a plurality of breaching bubbles.

3. A series of packages as defined claim 1, wherein the enclosure of each package contains a plurality of separate compartments.

4. A series of packages as defined in claim 3, wherein a different product is contained in each of the plurality of compartments.

5. A series of packages as defined in claim 3, wherein each portion of a tab area that seals one of the plurality of compartments contains at least one breachable bubble on each package.

6. A series of packages as defined in claim 1, wherein the series of packages are formed from a single piece of material.

7. A series of packages as defined in claim 1, wherein the seal line further comprises perforations.

8. A series of packages as defined in claim 1, wherein the complementary bubbles on adjacent packages are formed from a single bubble that is divided by the seal line.

9. A series of packages as defined in claim 1, wherein the breachable bubbles are formed by trapping a gas present between the two opposing films.

10. A series of packages as defined in claim 1, wherein the opposing films that form one of the tabs on each package are partially separated upon breaching of the at least one breachable bubble and the partially separated films may be used as flaps for a user to peel apart to further open said sealed tab.

11. A series of packages as defined in claim 1, wherein each breachable bubble on the series of packages have a shape similar to a half circle.

12. A series of packages as defined in claim 1, wherein each enclosure of the series of packages is sealed from the other enclosures of the series of packages.

* * * * *